United States Patent [19]

Cox et al.

[11] 4,244,855

[45] Jan. 13, 1981

[54] LIQUID GOLF BALL CENTER

[75] Inventors: Alvon R. Cox, Ashland; Thomas A. Molyneaux, Mansfield, both of Ohio

[73] Assignee: Abbott Laboratories, North Chicago, Ill.

[21] Appl. No.: 945,949

[22] Filed: Sep. 26, 1978

[51] Int. Cl.[3] ..... C08K 5/01

[52] U.S. Cl. ..... 260/33.6 AQ; 260/42.47; 273/231

[58] Field of Search ..... 273/231, 233; 260/33.6 AQ, 42.47; 525/901, 314

[56] References Cited

U.S. PATENT DOCUMENTS

| | | | |
|---|---|---|---|
| 3,031,194 | 4/1962 | Strayer | 273/231 |
| 3,373,123 | 3/1968 | Brice | 273/214 |
| 3,534,965 | 10/1970 | Harrison et al. | 273/218 |
| 3,649,587 | 3/1972 | Beckman et al. | 260/42.47 |
| 3,870,676 | 3/1975 | Condon | 260/33.6 AQ |
| 3,987,002 | 10/1976 | Lakshmanan | 260/42.47 |
| 4,048,254 | 9/1977 | Hillier et al. | 428/36 |
| 4,048,255 | 9/1977 | Hillier et al. | 525/71 |
| 4,051,197 | 9/1977 | Fodor | 525/314 |
| 4,076,255 | 2/1978 | Moore et al. | 260/42.47 |
| 4,101,482 | 7/1978 | Doss et al. | 260/42.47 |
| 4,148,771 | 4/1979 | Nash | 525/901 |

*Primary Examiner*—Lewis T. Jacobs

*Attorney, Agent, or Firm*—Robert L. Niblack; Neil E. Hamilton

[57] ABSTRACT

Radial block copolymers of the butadiene-styrene type are utilized in an uncured state to form a core wall for a liquid golf ball center which permits rapid production with better size and weight control than is currently available. The golf ball core wall containing the radial block copolymers can be formulated to obtain the specific properties desired by a particular manufacturer and can be manufactured at a lower cost than those presently available.

14 Claims, No Drawings

LIQUID GOLF BALL CENTER

BACKGROUND OF THE INVENTION

This invention relates to thermoplastic polymers which are useful in molding centers for golf balls. More particularly, it relates to the use of thermoplastic polymers composed of block radial polymers of the dienearyl substituted olefin butadiene-styrene type which contains a major portion of a filler material to form a core wall for a liquid golf ball center offering versatility in meeting manufacturing specifications as well as high production rates with precise size and weight control.

Currently golf balls are produced in the following forms:

1. A one component solid construction composed of a homogeneous mass consisting of polybutadiene, monomers, fillers, antioxidants, curing agents, etc.
2. A two component golf ball comprising a cover composed of natural rubber (Balata) or plastic (Surlyn) including urethane; and a core composed of a solid homogeneous mass similar to Item #1.
3. A three component golf ball composed of a cover composed of Balata rubber, plastic (Surlyn) or similar material; a winding composed of natural and/or synthetic rubber thread; and a core made from natural or synthetic polymers.
4. A four component golf ball having a cover as described in Items 2 and 3; a winding as described in Item 3; a core wall made from natural and/or synthetic rubber; and a liquid center composed of glycerin, polyethylene glycol, salt solutions, etc.

The golf ball center of the type concerned with in this invention is the Core Cover in Item 4. Golf balls with liquid filled centers are popular because the liquid cannot be compressed, but does deform upon impact from the golf club, thereby allowing the golfer a wide range of control. This is accomplished because, for a given compression, there is more ball in contact with the club head at the moment of impact. This segment of the four-component construction is costly to produce as it entails the encapsulation of an exact amount of liquid within a rubber covered sphere.

Block copolymers of butadiene-styrene and styrene-butadiene-styrene type are described in U.S. Pat. No. 3,534,965 to produce a solid golf ball. The block copolymers are blended and cured to result in the solid golf ball. Styrene-butadiene copolymers are also vulcanized in a blend with a polytetrahydrofuran to form a molded golf ball in U.S. Pat. No. 3,373,123. In U.S. Pat. Nos. 4,048,254 and 4,048,255 blends of uncured radial block copolymers are described for use with a third polymeric material for use in making thermoplastic materials for pharmaceutical purposes. The prior art nowhere describes a noncross-linked, butadiene-styrene radial block copolymer having a specific butadiene and styrene content in combination with a major portion of a filler material for use in the manufacture of a core wall for a liquid golf ball center. Neither does the prior art indicate that a noncross-linked butadiene-styrene radial block copolymer can be employed in formulations for composing liquid golf ball centers wherein the use of fillers and extenders can be freely incorporated to obtain centers meeting precise manufacturing specifications and at high production rates.

It is an advantage of the present invention to provide a core wall for a liquid golf ball center composed of a noncross-linked butadiene-styrene radial block copolymer. Other advantages are a liquid golf ball center containing a major portion of filler material as well as extenders so as to permit versatility in achieving desired properties for a golf ball; a liquid golf ball center which can be molded by various molding techniques including injection molding so as to afford rapid production as well as size and weight control; a liquid golf ball composition which eliminates the need for curing and permits the reuse of any trim and runner system material.

SUMMARY OF THE INVENTION

The foregoing advantages are accomplished and the shortcomings of the prior art are overcome by the present composition for a liquid golf ball center core wall which includes a noncross-linked, butadiene-styrene radial block copolymer having a butadiene content in the range of about 60–80% by weight and a styrene content in the range of about 20–40% by weight. A major portion of the golf ball core wall center composition includes a filler material with the noncross-linked butadiene-styrene radial block copolymer as well as an extender in the form of an oil. The radial block copolymer will have a molecular weight of at least 150,000 and can be as high as 300,000. In one embodiment of the invention, one radial block copolymer will be employed having a molecular weight of 300,000. In another embodiment two radial block copolymers will be utilized having different butadiene-styrene amounts and molecular weights. The copolymers can be present in equal or different weight amounts. A filler material will compose at least one-half of the total composition by weight in all embodiments and preferably will be present in an amount of about 60–80% by weight of the core wall composition. An extender may also be present in the range of about 5–20% by weight of total core center wall composition.

DESCRIPTION OF THE PREFERRED EMBODIMENT

The radial block copolymers utilized in the following Examples are readily available on the commerical market and are composed of 60–80% by weight of butadiene and 20–40% by weight of styrene. The radial block copolymers have a molecular weight ranging from 150,000 to 300,000 as measured by inherent viscosity in toluene; and a specific gravity ranging from 0.92 to 0.95. The preferred radial block copolymers are sold under the tradename SOLPRENE and available from the Phillips Petroleum Company.

The invention is disclosed in further detail by means of the following Examples which are set forth for the purpose of illustrating the invention, but, in no way are to be construed as limiting the invention to the precise amounts, ingredients or conditions indicated.

EXAMPLE I

| Ingredients | Formula by Parts (phr*) |
|---|---|
| Radial Block Copolymer (80:20 Butadiene-Styrene) | 75 |
| Radial Block Copolymer (70:30 Butadiene-Styrene) | 25 |
| Filler (Barium Sulfate) | 252 |
| Extender (Paraffinic Oil) | 25 |
| Antioxidant | |

-continued

| Ingredients | Formula by Parts (phr*) |
|---|---|
| (Hindered Phenol) | 1.0 |
| | 378.0 |

*Parts/Hundred/Rubber Polymer

The barium sulfate and the antioxidant are placed in a Banbury-type internal mixer of suitable capacity. The mixing device is operated for 30 seconds after which the radial block copolymers are added and approximately one-third of the paraffinic oil. Mixing is subsequently effected until three minutes after which an additional one-third of the paraffinic oil is added and after four minutes the balance of the paraffinic oil. The mixing unit is operated for an additional minute to bring the total mixing time to five minutes. After this time, the entire ingredients are dumped from the mixer at a temperature of 100–125 degrees C. onto mill rolls which should have a temperature in the range of 75–85 degrees C. for the stripping off of the material and its cooling. The cooled material can then be diced into a 150–3/16 inch cube for later injection molding. Core wall hemispheres or half spheres are then injection molded by any suitable injection molding device. The half spheres or core walls will be immersed in water-glycerine solution or polyethylene glycol. They will be compressed together trapping the liquid inside. Sealing of the half sphere is accomplished by use of a suitable adhesive. The liquid center will then be frozen and wound in the usual manner with natural and/or synthetic rubber thread and covered with a natural rubber (Balata), plastic (Surlyn) or similar material.

EXAMPLE II

| Ingredients | Formula by Parts (phr*) |
|---|---|
| Radial Block Copolymer (80:20 Butadiene-Styrene) | 50 |
| Radial Block Copolymer (70:30 Butadiene-Styrene) | 50 |
| Filler (Barium Sulfate) | 490 |
| Extender (Paraffinic Oil) | 100 |
| Antioxidant (Hindered Phenol) | 0.5 |
| | 690.5 |

*Parts/Hundred/Rubber Polymer

The radial block copolymers, the barium sulfate and the antioxidant are placed in a high speed intensive mixer. The added materials are mixed for approximately 30 seconds after which time the paraffinic oil is added with the blender being operated at 1200 rpm. 40–50 phr of oil should be added over approximately 40–60 seconds. The mixing is continued at 1500 rpm until the compound appears to be free flowing. After this period of time the mixer is operated at 2000 to 2500 rpm for an additional 30 seconds. After approximately 1½ minutes of blending, the mixed material is dumped into a ribbon blender and cooled to a temperature of 35 degrees C. The cooled and mixed material can then be pelletized in the usual manner from an extruder for later injection molding and filling of the core cover as well as final fabrication of the golf ball as indicated in Example I.

The type of blending equipment utilized in the Examples will depend upon what physical form the radial block copolymer is in when supplied. For example, if it is in the form of a bale, a Banbury-type internal mixer would only be used with a cooling facility and take-off. In the instance where it would be supplied in the form of a crumb or pelleted a Banbury mixer could likewise be employed and also a high-speed, intensive, dry blender such as a Welex, Littleford, Henschel or equivalent equipment with a ribbon blender for cooling. The Banbury mixer will accommodate all three forms and has the advantage that it will accommodate higher use of fillers and extenders without fear of separation of the ingredients from the polymer. In contrast, the dry blend mixing offers the advantage of faster mixing cycles; lower power consumption; elimination of the take-off mill at the Banbury mixer. The material can be processed directly from the dry blender into a plastic processing equipment such as an injection molding machine.

Table I indicates in formulations A, B, C and D additional formulations of the radial block copolymers where only a single radial block copolymer is employed. These formulations will be compounded as indicated in Example I and II. Table I also designates the percent of rebound and durometer for the various formulations as well as specific gravities.

It will be seen from the various formulations that the filler material as represented by barium sulfate composes a major portion of the weight of the core wall. The amount of this material can range from about 60% to about 80% by weight of the core wall. While barium sulfate (Barytes) is the preferred filler material the following filler materials could likewise be employed in the same weight range: calcium carbonate, aluminum silicate, fumed colloidal silica (Carbosil), silica, magnesium silicate, carbon black, calcined aluminum silicate, precipitated hydrated silica, zinc sulfide (Lithophone), magnesium carbonate, hydrated aluminum silicate, wet ground mica and silicon dioxide.

The use of an extender is optional. When it is present it can range in an amount from about 5% to 20% by weight of the core wall or the formulation. While a paraffinic type is preferred and preferably of the mineral-oil type, other oil-type extenders of the napthenic variety could likewise be utilized with the aromatic oils being the least desired.

In Table II, physical dimensions are presented for the liquid centers produced from the formulations of this invention. This Table indicates the precise range of physical dimensions which can be accomplished for a liquid golf ball center.

From the information given in the Tables, it will be seen that the low styrene content and high butadiene content results in a liquid golf ball center with highly desired durometers and specific gravities. Those formulations indicate that the use of fillers and extenders can be freely employed to obtain the desired properties of a liquid golf ball center.

From the data presented in Table I it will be seen that a radial block copolymer having a molecular weight of 300,000 and a butadiene-styrene amount of 70, 30% respectively is preferred when the copolymer is used alone. It will be further seen that with reference to Table I that the preferred radial block copolymer mixtures of this invention have different molecular weights and different butadiene-styrene amounts. However, when the preferred mixtures are employed the copolymers can range from 25:75 to 75:25 parts by weight.

It will thus be seen that through the present invention there is now provided a formulation for a core wall for a liquid golf ball center which allows for a large latitude in formulation so as to accomplish the specific performance specifications. The utilization of an uncured radial block copolymer also affords injection molding with faster rates in that no curing or time consuming cross linkage need take place. Also, any finished materials which do not meet specifications can be reused, which is not possible when using a cross-linked polymeric material. Additionally, the injection molding process with the butadiene-styrene thermoelastomers permits precise size and weight control which is not accomplished when utilizing compression molding.

The foregoing invention can now be practiced by those skilled in the art. Such skilled persons will know that the invention is not necessarily restricted to the particular embodiments presented herein. The scope of the invention is given meaning by the preceding description.

Table I (a)

| Polymer Radial Block | Mol Wt × 1000 | % Styrene | % Butadiene | A | B | C | D | E | F | G |
|---|---|---|---|---|---|---|---|---|---|---|
| 1 | 160 | 20 | 80 | | | | | 75.0 | 75.0 | 75.0 |
| 2 | 300 | 30 | 70 | 100.0 | 100.0 | 100.0 | 100.0 | | | |
| 3 | 150 | 30 | 70 | | | | | | | |
| 4 | 150 | 40 | 60 | | | | | 25.0 | 25.0 | 25.0 |
| Filler | | | | 170.0 | 180.0 | 250.0 | 280.0 | 200.0 | 210.0 | 220.0 |
| Extender | | | | | | | | 25.0 | 25.0 | 25.0 |
| Antioxidant | | | | 1.0 | 1.0 | 1.0 | 1.0 | 1.0 | 1.0 | 1.0 |
| | | | | 271.0 | 281.0 | 351.0 | 381.0 | 326.0 | 336.0 | 346.0 |
| Shore A Durometer | | | | 58 | 59 | 65 | 68 | 70 | 70 | 70 |
| Specific Gravity | | | | 1.839 | 1.873 | 2.124 | 2.209 | 1.787 | 1.820 | 1.853 |
| % Rebound (Based on Solid Balls) | | | | | | | | 67 | 67 | 67 |

Table I (b)

| Polymer Radial Block | Mol Wt × 1000 | % Styrene | % Butadiene | H | I | J | K | L | M | N |
|---|---|---|---|---|---|---|---|---|---|---|
| 1 | 160 | 20 | 80 | 75.0 | 75.0 | 75.0 | 75.0 | 75.0 | 75.0 | 75.0 |
| 2 | 300 | 30 | 70 | | | | | | | |
| 3 | 150 | 30 | 70 | | | | | | | |
| 4 | 150 | 40 | 60 | 25.0 | 25.0 | 25.0 | 25.0 | 25.0 | 25.0 | 25.0 |
| Filler | | | | 230.0 | 250.0 | 252.0 | 260.0 | 270.0 | 280.0 | 325.0 |
| Extender | | | | 25.0 | 25.0 | 25.0 | 25.0 | 25.0 | 25.0 | 25.0 |
| Antioxidant | | | | 1.0 | 1.0 | 1.0 | .5 | .5 | .5 | .5 |
| | | | | 356.0 | 376.0 | 378.0 | 385.5 | 395.5 | 405.5 | 450.5 |
| Shore A Durometer | | | | 70 | 70 | 70 | 65 | 65 | 65 | 65 |
| Specific Gravity | | | | 1.880 | 1.933 | 1.940 | 1.979 | 2.011 | 2.037 | 2.153 |
| % Rebound (Based on Solid Balls) | | | | 66 | 66 | 66 | | | | |

Table I (c)

| Polymer Radial Block | Mol Wt × 1000 | % Styrene | % Butadiene | O | P | Q | R | S | T | U |
|---|---|---|---|---|---|---|---|---|---|---|
| 1 | 160 | 20 | 80 | 75.0 | 75.0 | 75.0 | 50.0 | 50.0 | 50.0 | 50.0 |
| 2 | 300 | 30 | 70 | | | | | | | |
| 3 | 150 | 30 | 70 | | | | 50.0 | 50.0 | 50.0 | 50.0 |
| 4 | 150 | 40 | 60 | 25.0 | 25.0 | 25.0 | | | | |
| Filler | | | | 350.0 | 315.0 | 355.0 | 450.0 | 460.0 | 470.0 | 480.0 |
| Extender | | | | 25.0 | 25.0 | 25.0 | 75.0 | 75.0 | 75.0 | 75.0 |
| Antioxidant | | | | .5 | .5 | .5 | .5 | .5 | .5 | .5 |
| | | | | 475.5 | 440.5 | 480.5 | 625.5 | 635.5 | 645.5 | 655.5 |
| Shore A Durometer | | | | 65 | 65 | 65 | 50 | 50 | 50 | 50 |
| Specific Gravity | | | | 2.212 | 2.113 | 2.217 | 2.115 | 2.151 | 2.158 | 2.169 |
| % Rebound (Based on Solid Balls) | | | | | | | | | | |

Table I (d)

| Polymer Radial Block | Mol Wt × 1000 | % Styrene | % Butadiene | V | W | X | Y | Z | AA | BB |
|---|---|---|---|---|---|---|---|---|---|---|
| 1 | 160 | 20 | 80 | 50.0 | 75.0 | 50.0 | 50.0 | 50.0 | 50.0 | 50.0 |
| 2 | 300 | 30 | 70 | | | | | | | |
| 3 | 150 | 30 | 70 | 50.0 | | 50.0 | 50.0 | 50.0 | 50.0 | 50.0 |
| 4 | 150 | 40 | 60 | | 25.0 | | | | | |
| Filler | | | | 490.0 | 610.0 | 450.0 | 460.0 | 470.0 | 480.0 | 490.0 |
| Extender | | | | 75.0 | 100.0 | 100.0 | 100.0 | 100.0 | 100.0 | 100.0 |
| Antioxidant | | | | .5 | .5 | .5 | .5 | .5 | .5 | .5 |
| | | | | 665.5 | 810.5 | 650.5 | 660.5 | 670.5 | 680.5 | 690.5 |
| Shore A Durometer | | | | 50 | 40 | 40 | 40 | 40 | 40 | 40 |

Table I (d)-continued

| Polymer Radial Block | Mol Wt × 1000 | % Styrene | % Butadiene | V | W | X | Y | Z | AA | BB |
|---|---|---|---|---|---|---|---|---|---|---|
| Specific Gravity | | | | 2.186 | 1.982 | 1.985 | 2.019 | 2.032 | 2.051 | 2.071 |
| % Rebound (Based On Solid Balls) | | | | | | | | | | |

Table II

| Formula | Finished Weight Required (Grams) | Size | Wall Thickness Required | Inside Volume (C.C.) | Outside Volume (C.C.) | Volume of Radial Polymer (C.C.) | Liquid | Weight of Liquid (Grams) | Specific Gravity Required |
|---|---|---|---|---|---|---|---|---|---|
| 1 | 16.15 | 1-1/16" | .090" | 5.880 | 10.262 | 4.382 | Water & Glycerin | 6.174 | 2.2766 |
| 2 | 16.15 | 1-1/16" | .140" | 4.099 | 10.262 | 6.163 | Water & Glycerin | 4.304 | 1.9221 |
| 3 | 15.90 | 1-1/16" | .090" | 5.880 | 10.262 | 4.382 | Water & Glycerin | 6.174 | 2.2196 |
| 4 | 15.90 | 1-1/16" | .140" | 4.099 | 10.262 | 6.163 | Water & Glycerin | 4.304 | 1.8816 |
| 5 | 16.15 | 1-1/16" | .090" | 5.880 | 10.262 | 4.382 | Polyethylene Glycol | 6.556 | 2.1894 |
| 6 | 16.15 | 1-1/16" | .140" | 4.099 | 10.262 | 6.163 | Polyethylene Glycol | 4.570 | 1.8789 |
| 7 | 15.90 | 1-1/16" | .090" | 5.880 | 10.262 | 4.382 | Polyethylene Glycol | 6.556 | 2.1323 |
| 8 | 15.90 | 1-1/16" | .140" | 4.099 | 10.262 | 6.163 | Polyethylene Glycol | 4.570 | 1.8383 |

I claim:

1. A liquid golf ball center having a substantially spherical form and capable of being injection molded with precise size and weight control comprising:

(a) a substantially spherical core wall comprising:

(i) a noncross-linked and uncured, butadiene-styrene radial block copolymer having a butadiene content in the range of about 60% to 80% by weight and a styrene content in the range of about 20% to 40% by weight; and (ii) a filler material; and (b) a liquid center; said filler material composing at least one-half by weight of said golf ball core wall and said radial block copolymer having a molecular weight of at least 150,000.

2. The liquid golf ball center as defined in claim 1 wherein said core wall further includes an extender composed of an oil.

3. The liquid golf ball center as defined in claim 1 wherein said core wall has a thickness in the range of about 0.090 inch to 0.140 inch.

4. The liquid golf ball center as defined in claim 1 wherein said filler material is present in the range of about 60% to about 80% by weight of the core wall.

5. The liquid golf ball center as defined in claim 2 wherein said extender is present in an amount in the range of about 5% to 20% by weight of the core wall.

6. The liquid golf ball center as defined in claim 2 wherein said liquid is represented by a mixture of water and glycerine or polyethylene glycol.

7. The liquid golf ball center as defined in claim 4 wherein said filler material is barium sulfate.

8. The liquid golf ball center as defined in claim 1 wherein the butadiene-styrene radial block copolymer has a molecular weight of about 300,000.

9. The liquid golf ball center as defined in claim 8 wherein said copolymer has a butadiene content of about 70% and a styrene content of about 30%.

10. The liquid golf ball center as defined in claim 1 wherein the buadiene-styrene radial block copolymer has a molecular weight of abut 160,000 and further including an additional butadiene-styrene radial block copolymer having a butadiene content in the range of about 60% to 80% by weight and a styrene content in the range of about 20% to 40% by weight and a molecular weight of about 150,000, and said copolymers having different butadiene-styrene amounts.

11. The liquid golf ball center as defined in claim 10 wherein said copolymers are present in equal amounts.

12. The liquid golf ball center as defined in claim 10 wherein said copolymers are present in different amounts.

13. The liquid golf ball center as defined in claim 12 wherein said copolymer having a molecular weight of about 160,000 is present in a larger amount by weight.

14. The liquid golf ball center as defined in claim 10 wherein said copolymer having a molecular weight of 160,000 is present in an amount of 50 to 75 parts by weight and said copolymer having a molecular weight of 150,000 is present in an amount of 50 to 25 parts by weight.

* * * * *